US007287718B2

(12) United States Patent
Cano et al.

(10) Patent No.: US 7,287,718 B2
(45) Date of Patent: Oct. 30, 2007

(54) METHOD OF FEEDING A MEDIUM AND MEDIUM FEEDING SYSTEM

(75) Inventors: Emilio Cano, Barcelona (ES); Cristian Cachera, Barcelona (ES); David Claramunt, Sant Esteve Sesrovires (ES); Pedro Luis Las Heras, Sant Quirze del Valles (ES); Marta Tua, Barcelona (ES); Joan Alonso, Barceona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 161 days.

(21) Appl. No.: 11/117,461

(22) Filed: Apr. 29, 2005

(65) Prior Publication Data

US 2006/0243848 A1 Nov. 2, 2006

(51) Int. Cl.
*B65H 23/06* (2006.01)

(52) U.S. Cl. ..... 242/422.9; 400/618

(58) Field of Classification Search ..... 242/422, 242/422.1, 422.4, 422.9, 422.8, 416, 420, 242/421; 188/83, 84, 82.77; 400/613, 618; 101/DIG. 41, DIG. 42
See application file for complete search history.

(56) References Cited

U.S. PATENT DOCUMENTS

| | | | | |
|---|---|---|---|---|
| 5,709,481 | A * | 1/1998 | Hinojosa et al. | 384/219 |
| 6,478,489 | B2 * | 11/2002 | Hierro | 400/618 |
| 2002/0102122 | A1 * | 8/2002 | Hierro | 400/618 |

* cited by examiner

*Primary Examiner*—Peter M. Cuomo
*Assistant Examiner*—William E Dondero

(57) ABSTRACT

A medium feeding system for a hardcopy apparatus comprising: a revolving arrangement for supporting a roll of medium, the revolving arrangement comprising a friction ring, the friction ring rotating around a friction ring rotation axis; and a braking element comprising two pivotally arranged jaws, whereby the friction ring is bitten by said jaws; whereby the braking element is rotatable around the friction ring rotation axis; and means to push the jaws against the friction ring; and means to pull the jaws away from the friction ring; whereby the means to pull the jaws away from the friction ring are triggered by the rotation of the friction ring.

22 Claims, 2 Drawing Sheets

METHOD OF FEEDING A MEDIUM AND MEDIUM FEEDING SYSTEM

BACKGROUND OF THE INVENTION

1. Field of the Invention

The present invention generally relates to hardcopy apparatus, such as copiers, printers, scanners, and facsimiles, and more particularly to improved media advancing devices for such apparatus.

2. Description of the Prior Art

In hardcopy apparatuses and particularly in apparatuses handling media of large size, such as large format printers, a printed medium is fed to the printer from a roll of medium, the roll of medium being submitted to a braking force in order to ensure that a back-tension is maintained on the medium in order to avoid misalignments which may be caused by loose medium feeding. Conventional braking devices use a friction torque for this purpose, employing for example a braking shoe applying a predetermined braking force such as disclosed in EP 0 905 072 A1 in order to apply such a friction torque.

The friction torque is dependent on the amount of braking force applied, but also on the coefficient of friction at the zone of friction considered. The coefficient of friction itself is highly dependent on the type of medium used as well as on the conditions at the zone of friction. During use, it is for example common that dirt gets deposited at the zone of friction, for example. The consequence is that the friction torque varies which in turn means that the back-tension on the roll of media can become inappropriate.

An object of the present invention is to achieve a braking effect which remains significantly constant over time and usage and hence provide a predictable tension of the medium regardless of the variation of the coefficient of friction at the zone of friction on the roll.

The present invention provides an improved method of feeding a medium as well as an improved medium feeding system.

SUMMARY OF THE INVENTION

In its first main aspect, the invention relates to a method of feeding a medium to a hardcopy apparatus comprising:

- providing a revolving arrangement for supporting a roll of medium; and
- applying a braking force producing a friction torque at a friction zone on the revolving arrangement; and
- varying the value of the braking force in function of the value of the coefficient of friction at the friction zone.

Hardcopy apparatuses include devices such as photocopiers, printers, scanners or typewriters handling media typically in the form of sheets or rolls. The material forming the medium may be of different types but generally includes paper, cardboard, plastic resins, woven or unwoven fibers or textile or mixtures between two or more of these materials. Among these, the invention demonstrated more particularly of use when applied to printing devices, more specifically ink jet printers, even more specifically thermal ink jet printers.

In an embodiment, the invention was applied to apparatuses handling large format media. By large format, it is meant a format larger than about 8.26 inches by about 11.69 inches. Other typical formats have a width of 24 or 36 or 40 or 60 inches, the medium being rolled along its length. Such large format apparatuses are commonly used for handling rolls of medium of large dimensions so that the constraints on undesired displacement or misalignment of the medium during processing—typically printing—are particularly high. Furthermore, such apparatuses are typically meant for professional use, whereby the quality and consistency of the output is of particular importance.

A typical roll of medium is formed by an accumulation of layers of medium in a sheet form which are typically rolled around a revolving arrangement, the revolving arrangement typically comprising an elongated cylindrical support structure generated by a circular or annular cross-section. The medium is tightly rolled around the revolving arrangement in order to minimize any play between the roll of medium and the revolving arrangement. The revolving arrangement typically further includes connecting means as well as a supporting tube, the supporting tube being commonly made of cardboard, the medium being rolled around the supporting tube, and connecting means providing the connection between the supporting tube and the hardcopy apparatus. The connecting means could comprise a bar which would fit into the tube, but could also comprise one or a pair of end pieces which would fit tight at one or respectively each of the ends of the tube. The role of such connecting means is to allow engagement of the roll of medium with the rest of the feeding system. It should be noted that the supporting tube is normally replaced when the medium comes to an end, the connecting means being possibly reusable. The roll of medium is normally revolving around its own axis, the medium being pulled progressively from the roll in order to be processed, typically printed. In a standard hardcopy apparatus, the revolving movement is produced by pulling the medium, typically using a motorized roller system. The roll of medium and the revolving arrangement are themselves normally not directly motorized, which means that their revolving movement is a consequence of the pulling force on the medium.

During this rotation of the roll of medium, the revolving arrangement is submitted to friction in order to maintain a back-tension on the medium being pulled. This back-tension participates in maintaining the alignment of the medium, thus participating in improving the processing, typically printing. The friction is generated by applying a braking force at a friction zone on the revolving arrangement. It should be noted that the friction zone may be placed at a variety of locations on the revolving arrangement, such as on the support tube or on the connecting means. The friction directly permits the application of a back-tension on the medium when the medium is being pulled from the roll of medium. By friction zone, it should be understood a zone of contact between two pieces, one piece being part of the revolving arrangement, the other piece being the piece used to apply the gracing force. The friction zone may be substantially punctual in so far as its area may be significantly reduced, such as covering an area of less than 3 $mm^2$. The friction zone may also have a surface area of more than 3 $mm^2$.

According to the invention, the value of the braking force varies in function of the value of the coefficient of friction at the friction zone. It should be noted that the braking force also varies in function of other parameters, such as for example the strength of the tensioning element when applicable. It should also be noted that the invention permits regulation not only in function of a variation of the coefficient of friction but also in function of a variation of other parameters, such as for example the strength of the tensioning element when applicable. In this manner, the value of the coefficient of friction may be compensated in order to maintain the back-tension relatively independently of the coefficient of friction. The coefficient of friction is a dimensionless coefficient μwhich fulfills the following equation: F1=μ.F2, where F1 is the value or modulo of the friction force and where F2 is the value or modulo of the component of the braking force normal or perpendicular to the friction zone. In an embodiment of the invention, the coefficient of friction is comprised in the range of 0.1 to 0.3, or in any range included in this one.

In an embodiment, a second braking force is provided at a second friction zone on the revolving arrangement, whereby the value of the second braking force varies in function of the value of the coefficient of friction at the second friction zone. The second force may also have a value independent of the value of the coefficient of friction. In another embodiment, a third and a fourth braking force are provided at respectively a third and a fourth friction zone on the revolving arrangement, whereby the value of the third and fourth braking forces vary in function of the value of the coefficient of friction at the respectively third and fourth friction zone. In an embodiment, the plurality of friction zones are regularly located and evenly spaced around the revolving arrangement, being typically placed at regular angles around the perimeter of the revolving arrangement, such as at diametrically opposed ends in the case of two friction zones.

In its second main aspect the invention relates to a method of feeding a medium to a hardcopy apparatus comprising:

providing a revolving arrangement for supporting a roll of medium; and applying a variable force producing a friction torque at a friction zone on the revolving arrangement; and reducing the variable force at the zone of friction as the coefficient of friction increases.

In this second aspect, the revolving arrangement is submitted to a friction torque which normally opposes itself to the force pulling the medium, the friction torque being produced by the application of a variable force at a friction zone on the revolving arrangement. The force is variable insofar as the force reduces as the coefficient of friction increases. This variation allows a regulation of the friction torque in so far as the effect of an increase of the coefficient of friction would lead to an increase of the friction torque if a constant force is applied. The variable force may increase at the zone of friction as the coefficient of friction decreases. In this manner it is possible to control the variation of the friction torque in the aim of regulating it as desired. It should be noted that the medium feeding system according to the third aspect of the invention is comprised in a hardcopy apparatus.

In an embodiment of the invention, the friction torque is maintained substantially constant while the coefficient of friction varies. In another embodiment, the friction torque varies between a maximum torque value Tmax and a minimum torque value Tmin, whereby the following equation is respected: $(Tmax-Tmin)<(0.15\times Tmax+0.15\times Tmin)$. In another embodiment, the friction torque varies between a maximum torque value Tmax and a minimum torque value Tmin, whereby the following equation is respected:

$$(Tmax-Tmin)<(0.1\times Tmax+0.1\times Tmin).$$

In an embodiment of the invention, a stable point of functioning is reached.

In its third main aspect, the invention relates to a medium feeding system for a hardcopy apparatus comprising:

a revolving arrangement for supporting a roll of medium; and a jaw for applying friction at a zone of friction of the revolving arrangement; and means to push the jaw against the revolving arrangement; and means to pull the jaw away from the revolving arrangement.

In the system according to the third aspect of the invention, the friction is applied by a jaw. The jaw is typically an elongated mechanical member which is pivotally articulated in relation to a base or to another jaw. The jaw normally comes into contact with the revolving arrangement at one zone of friction, but may also come into contact with the revolving arrangement at two or more distinct zones of friction.

The friction is applied to the revolving arrangements by the way of means to push the jaw against the revolving arrangement at the zone of friction. In an embodiment, the means to push the jaw is a mechanical spring. The means to push the jaw may be a helical or a tension spring, but the means may also be of hydraulical, electrical, magnetic or electromagnetic nature.

The medium feeding system according to the third aspect further comprises means to pull the jaw away from the revolving arrangement. Such means permit regulation of the intensity of the friction at the zone of friction. Such means may be triggered by an increase of the coefficient of friction at the zone of friction. Such means may be triggered by an increase of the friction torque at the zone of friction. In an embodiment, the jaws are pulled away and consequently the friction reduced if the coefficient of friction reaches a threshold value in order to maintain the backtension on the medium within a range.

In an embodiment, the revolving arrangement rotates around a rotation axis, whereby the means to pull the jaw comprise a bar having a first end and a second end, the first end of the bar being pivotally engaged with the jaw and the second end of the bar being pivotally engaged with a base, whereby both pivot engagements are allowing rotation around an axis parallel to the rotation axis of the revolving arrangement.

In another embodiment, the medium feeding system for a hardcopy apparatus comprises:

a revolving arrangement for supporting a roll of medium; and a jaw for applying friction at a zone of friction of the revolving arrangement; and means to push the jaw against the revolving arrangement; and means to pull the jaw away from the revolving arrangement;

the means to push the jaw being a mechanical spring, the revolving arrangement rotating around a rotation axis, whereby the means to pull the jaw comprise a bar having a first end and a second end, the first end of the bar being pivotally engaged with the jaw and the second end of the bar being pivotally engaged with a base, whereby both pivot engagements are allowing rotation around an axis parallel to the rotation axis of the revolving arrangement.

In its fourth main aspect, the invention relates to a medium feeding system for a hardcopy apparatus comprising:

a revolving arrangement for supporting a roll of medium, the revolving arrangement comprising a friction ring, the friction ring rotating around a friction ring rotation axis; and a braking element comprising two pivotally arranged jaws, whereby the friction ring is bitten by said jaws; whereby the braking element is rotatable around the friction ring rotation axis.

In this particular aspect, the revolving arrangement comprises a friction ring. The friction ring is a mechanical piece which is dedicated to receiving the friction torque of the invention. The friction may be made of a material particularly suited for this purpose. Such materials comprise stainless steel or thermoplastic resin optionally charged with filler. Other materials or mixture of materials may be used. The friction ring is a rotating piece, which rotates around a friction ring rotation axis. In another embodiment, the friction ring rotation axis is the revolution axis of the revolving arrangement. It should however be noted that the friction ring rotation axis may be parallel to the revolution axis of the revolving arrangement. The friction ring rotation axis may also be non-parallel to the revolving axis of the revolving arrangement. The friction ring and the revolving arrangement are normally mechanically coupled, for example using meshing gears or belts, or may more simply be integrally linked. It should be noted that the medium feeding system according to the third aspect of the invention is comprised in a large format printer.

The system according to the fourth main aspect of the invention further comprises a braking element comprising two pivotally arranged jaws, the friction ring being bitten by said jaws. The combination of the friction ring with the braking element comprising two pivotally arranged jaws allows applying the friction torque to the revolving arrangement whereby a friction torque is produced by the biting of the jaws. It should be noted that the jaws may be directly pivotally arranged the one two the other, or may be pivotally arranged by means of an intermediary arrangement.

In the system according to the fourth main aspect of the invention, the braking element is rotatable around the friction ring rotation axis. This ability for the braking element to rotate permits that the coefficient of friction at the zone of friction between the jaws and the friction ring be taken into account insofar as a threshold is introduced in this manner, whereby the braking element enters in rotation when and if the coefficient of friction becomes higher than the threshold. At this moment, the braking system follows the friction ring in rotation, the friction torque being consequently reduced, leading to a regulation of the friction torque and thereby a regulation of the back-tension on the medium. It should be understood that rotatable means here that the braking element is able to rotate but does not rotate freely.

In an embodiment, the rotation of the rotatable braking element is limited to a preset angle. This limitation has as a consequence that the braking element does not freely follows the friction ring once rotation of the braking element started. In an embodiment, the system regulates once the preset angle is reached.

In another embodiment, the system further comprises a fixed abutment and a lever, the lever having a first end, a second end and a lever rotation axis, the lever rotation axis being parallel to the friction ring rotation axis, the rotation axis being fixed relative to a first one of said jaws, the first end of the lever abutting against the second one of said jaws when the second end of the lever abuts against a fixed abutment. In this particular embodiment, a specific mechanical system comprising a lever is provided in order to permit regulation of the friction force and therefore the regulation of the back-tension on the medium. The abutment is a fixed abutment, which should be understood as an abutment which is fixed in the referential of the feeding system itself. The lever is normally not in contact with the fixed abutment but comes in contact with the fixed abutment with its second end if the braking element enters in rotation and reaches a preset angle. At this point, the lever enters in contact with its first end with the second jaw. It should be noted that the rotation axis of the lever is fixed relative to the first jaw, which means that the lever starts to push the second jaw away from the first jaw one the fixed abutment comes into contact with the second end of the lever, i.e. once the braking element reached the preset angle. The result of pushing the first jaw away from the second jaw is a further reduction of the torsion torque. It should be noted that the forces involved should not lead to a loss of contact between the jaws and the friction ring but rather to a loosening or a reduction of the friction torque. It is not intended to suppress the friction torque altogether but to reduce it only.

In an embodiment, the system further comprises a tensioning element, whereby the two pivotally arranged jaws are linked by the tensioning element. In an embodiment the tensioning element is a helicoidal spring. In another embodiment, the helicoidal spring is provided in the system of the fourth embodiment in combination with the lever arrangement as described above.

In its fifth main aspect, the invention relates to a medium feeding system for a hardcopy apparatus comprising:

a revolving arrangement for supporting a roll of medium, the revolving arrangement comprising a friction ring, the friction ring rotating around a friction ring rotation axis; and a braking element comprising two pivotally arranged jaws, whereby the friction ring is bitten by said jaws; whereby the braking element is rotatable around the friction ring rotation axis; and means to push the jaws against the friction ring; and means to pull the jaws away from the friction ring; whereby the means to pull the jaws away from the friction ring are triggered by the rotation of the braking element.

In an embodiment, the means to push the jaws against the friction ring is a mechanical spring. The means to push the jaws may be a helical or a tension spring, but the means may also be of hydraulical, electrical, magnetic or electromagnetic nature.

The medium feeding system according to the fifth aspect further comprises means to pull the jaws away from the friction ring. Such means permit regulation of the intensity of the friction at the zone of friction. Such means may be triggered by an increase of the coefficient of friction at the zone of friction. In an embodiment the jaws are pulled away and consequently the friction reduced if the coefficient of friction reaches a threshold value in order to maintain the backtension on the medium within a range. In this particular aspect, the means to pull the jaws away from the friction ring are triggered by the rotation of the braking element. In this particular aspect, the braking element being rotatable, it may follow the friction ring in rotation. It should be noted that the peripheral speed of the friction ring and the peripheral speed of the braking element at the zone of friction may not be equal. In fact, the peripheral speed of the friction ring may be equal or higher than the peripheral speed of the braking element. According to this aspect, once the braking element enters in rotation, the means to pull the jaws away are triggered. The triggering typically takes place when the braking element has been rotating of a preset angle. The consequence of pulling the jaws away is a reduction in the friction. In an embodiment, the braking element has a default position, and enters in rotation away from this default position only when a threshold of the coefficient of friction has been reached. If the angle of rotation reaches a preset angle, the means of pulling the jaws away enters in function, thus compensating the increase of the coefficient of friction by a reduction of the friction force. Typically, the braking element acts on a lever or on a bar if the preset angle of rotation is reached, leading to pulling the jaws away from the friction ring.

DESCRIPTION OF AN EMBODIMENT

Figure 1:
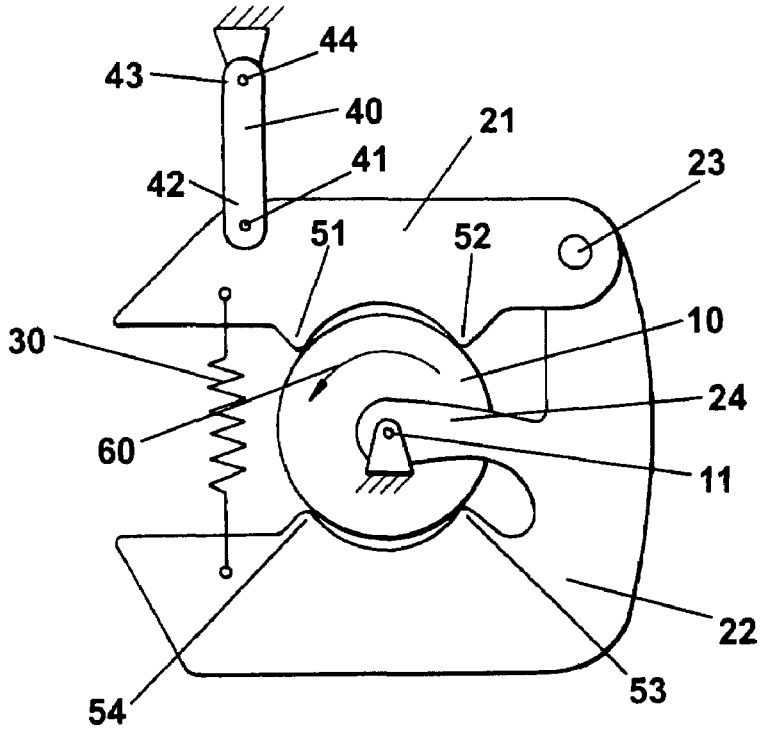
FIG. 1 is a view of an embodiment of a system according to the invention in relaxed position.

Referring to FIG. 1, an embodiment of the medium feeding system of the invention is represented. In this embodiment, a friction ring 10 part of a revolving arrangement is bitten between a first lower jaw 22 and a first upper jaw 21. The revolving arrangement 10 revolves around a rotation axis 11 which is fixed. The second jaw 21 and the first jaw 22 are pivotally linked by a pivot 23, the first jaw 22 and consequently the braking element comprising both jaws being rotatable around the pivot 11 via the extension 24. The jaws 21 and 22 are linked by the helicoidal spring 30 which acts as a tensioning element or means to push the jaws against the friction ring. The second jaw 21 is pivotally arranged with a first end 42 of a bar 40 at pivot 41, the second end 43 of the bar 40 being itself pivotally arranged with a fixed base at pivot 44. As will be explained, the bar acts as means to pull the jaws away from the friction ring. Friction is applied to the revolving arrangement 10 by the jaws 21 and 22 at four friction zones 51, 52, 53 and 54.

During feeding of the medium to a hardcopy apparatus according to an embodiment of a method according to the invention, the revolving arrangement rotates in the direction indicated by the arrow 60. The friction torque being dependent of the value of the coefficient of friction at each zone of friction, the friction torque will rise if the coefficient of friction rises, in such a manner that the braking element would start following the friction ring 10 in rotation.

Figure 2:
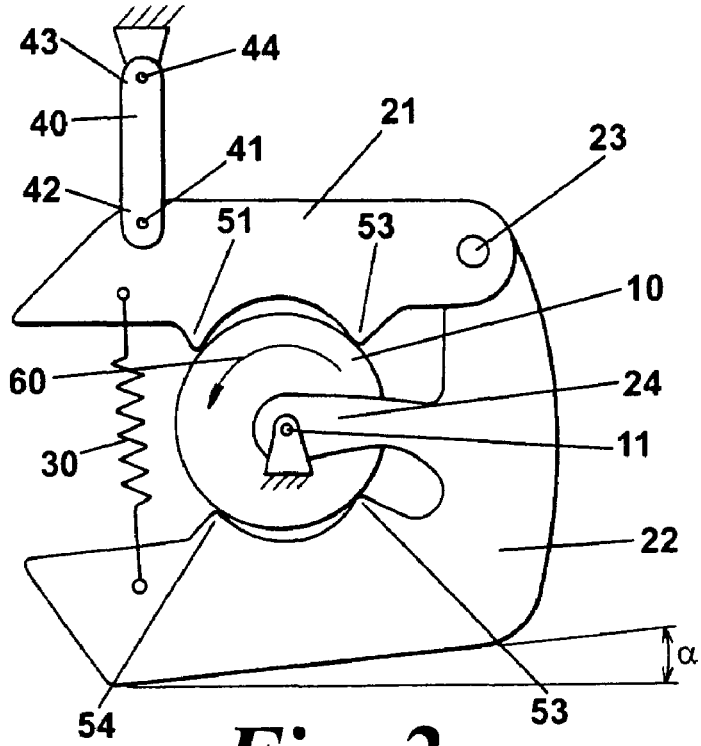
FIG. 2 is a view of the system of FIG. 1 in regulating position.

Referring to FIG. 2, the system of FIG. 1 is represented in a situation where the coefficient of friction became larger than a threshold value so that the braking element rotated of an angle alpha ($\alpha$). The rotation has the following consequences: pivot 11 and pivot 44 being fixed, and the distance between pivot 44 and pivot 41 being maintained constant by the bar 40 means that a rotation of the braking element results in opening the mouth formed by jaws 21 and 22 with the consequence of reducing the braking force and thus the friction torque at the zones of friction 51, 52, 53 and 54. A direct result of this reduction of the friction torque is a reduction of the angle alpha ($\alpha$) leading to closing the mouth formed by jaws 21 and 22, in such a way that the angle alpha may grow again etc, etc . . . An equilibrium may be reached at which the backtension has a minimal variation. This is the regulation cycle which allows maintaining a relatively constant back-tension on the medium. It should be noted that in FIG. 2 there is a loss of direct contact between the jaws and the friction ring at the zones of friction. This complete loss of contact does not normally happen in the actual system eventhough the friction force is actually reduced by loosening the bite of the jaws on the friction ring, thus loosening the tension produced by the tensioning element 30.

Figure 3:
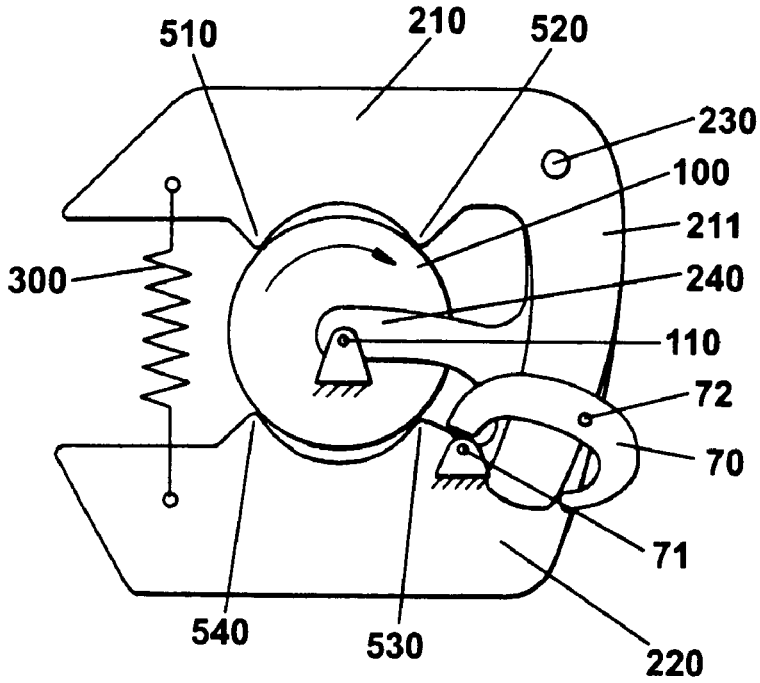
FIG. 3 is a view of another embodiment of a system according to the invention in relaxed position.

Referring to FIG. 3, an alternative system is provided whereby the friction ring 100 is bitten between first jaw 220 and second jaw 210, the jaws exerting a braking force resulting in a friction torque at four zones of friction 510, 520, 530 and 540. The friction ring rotates around axis 110 and the braking element formed by the jaws is rotatable around the same axis 110, which is a fixed axis. The jaws are pivotally arranged at pivot 230. The braking element is connected to the axis 110 by an extension 240 of the first jaw 220. The jaws are linked by the helicoidal spring 300 which acts as a tensioning element or means to push the jaws 210, 220 against the friction ring 100. In this particular embodiment, the braking element further comprises means to pull the jaw away from the revolving arrangement in the form of a lever assembly comprising a lever 70 and a fixed abutment 71, the lever being pivotally arranged with the first jaw 220 at pivot 72. In a relaxed position, which corresponds to a low range of coefficient of friction at the friction zones 510, 520, 530 and 540, the lever does not engage with the fixed abutment and remains loose.

Figure 4:
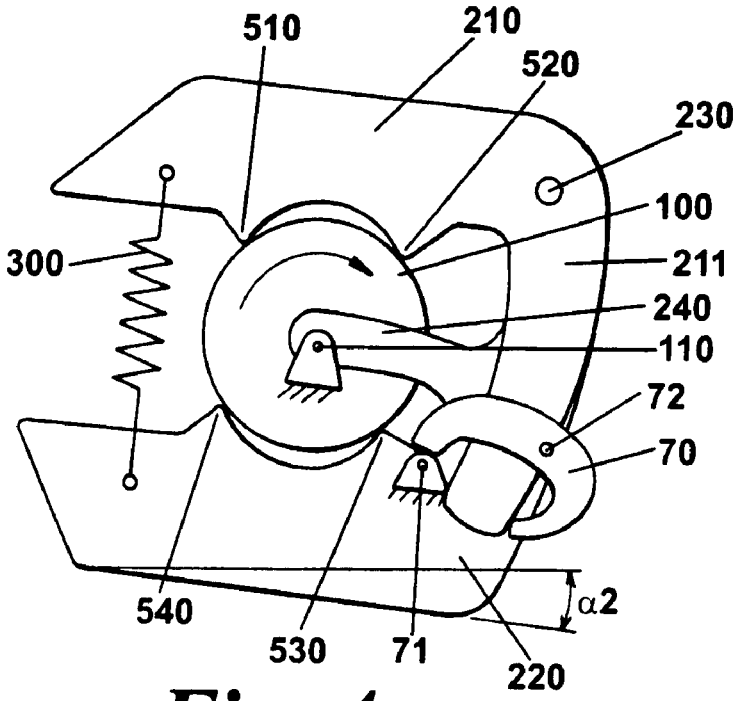
FIG. 4 is a view of the system of FIG. 3 during regulation.

If the coefficient of friction at the zones of friction 510, 520, 530 or 540 rises above a threshold value, the braking element enters in rotation around axis 110 following the rotation of the friction ring represented by arrow 60 as represented in FIG. 4 where the braking element has rotated of an angle alpha 2 ($\alpha 2$). Because the abutment 71 is fixed, a rotation of the braking element results in the abutment 71 engaging a second end of lever 70, the first end abutting against an extension 211 of the second jaw 220, leading to opening the mouth formed by jaws 210 and 220, thus reducing the braking force to compensate the rise of the coefficient of friction leading to a regulation of the friction torque. This does in turn lead to returning the braking element in its relaxed position as described in FIG. 3, the regulation cycle starting again at this point so that a relatively constant back-tension is obtained of the medium. A mechanical equilibrium may be reached.

It should be understood that in both the embodiment illustrated in FIGS. 1 and 2 and the embodiment illustrated in FIGS. 3 and 4 the system may become stable at a position between a relaxed position and a regulating position in the event of a rise of the coefficient of friction in order to control the value of the back-tension of the medium. The medium is being fed in both embodiments from a roll of medium which is directly linked to the friction ring and in the axis of the friction ring.

The invention claimed is:

1. A method of feeding a medium to a hardcopy apparatus comprising:

providing a revolving arrangement for supporting a roll of medium;

applying a braking force producing a friction torque at a friction zone on the revolving arrangement; and varying the value of the braking force as a function of a value of a coefficient of friction at the friction zone.

2. A method according to claim 1, whereby a second braking force is provided at a second friction zone on the revolving arrangement, whereby the value of the second braking force varies as a function of the value of the coefficient of friction at the second friction zone.

3. A method according to claim 2, whereby a third and a fourth braking force are provided at respectively a third and a fourth friction zone on the revolving arrangement, whereby the value of the third and fourth braking forces vary as a function of the value of the coefficient of friction at the respectively third and fourth friction zone.

4. A method according to claim 1, further including the action of rotating a braking element to increase the braking force as the value of the coefficient of friction increases.

5. A method of feeding a medium to a hardcopy apparatus comprising:

providing a revolving arrangement for supporting a roll of medium;

applying a variable force producing a friction torque at a friction zone on the revolving arrangement; and reducing the variable force at the zone of friction as a coefficient of friction increases.

6. A method according to claim 5, whereby the friction torque is maintained substantially constant while the coefficient of friction varies.

7. A method according to claim 5, whereby the friction torque varies between a maximum torque value Tmax and a minimum torque value Tmin, whereby the following equation is respected:

$$(T\max - T\min) < (0.15 \times T\max + 0.15 \times T\min).$$

8. A method according to claim 5, whereby the friction torque varies between a maximum torque value Tmax and a minimum torque value Tmin, whereby the following equation is respected:

$$(T\max - T\min) < (0.1 \times T\max + 0.1 \times T\min).$$

9. A medium feeding system for a hardcopy apparatus comprising:

a revolving arrangement for supporting a roll of medium;

a jaw for applying friction at a zone of friction of the revolving arrangement;

means to push the jaw against the revolving arrangement; and means to pull the jaw away from the revolving arrangement wherein the medium feeding system varies a value of a braking force resulting from pushing of the jaw against the revolving arrangement as a function of a value of a coefficient of friction between the jaw and the revolving arrangement.

10. A medium feeding system according to claim 9, whereby the means to push the jaw is a mechanical spring.

11. A medium feeding system according to claim 9, whereby the revolving arrangement rotates around a rotation axis, and whereby the means to pull the jaw comprise a bar having a first end and a second end, the first end of the bar being pivotally engaged with the jaw and the second end of the bar being pivotally engaged with a base, whereby both pivot engagements are allowing rotation around an axis parallel to the rotation axis of the revolving arrangement.

12. A medium feeding system according to claim 9, whereby the revolving arrangement rotates around a rotation axis, and whereby the means to pull the jaw comprise a bar having a first end and a second end, the first end of the bar being pivotally engaged with the jaw and the second end of the bar being pivotally engaged with a base, whereby both pivot engagements are allowing rotation around an axis parallel to the rotation axis of the revolving arrangement, whereby the means to push the jaw is a mechanical spring.

13. A medium feeding system according to claim 9, wherein the medium feeding system is configured to push the jaw to contact the revolving arrangement while the revolving arrangement is rotating relative to the jaw.

14. A medium feeding system for a hardcopy apparatus comprising:

a revolving arrangement for supporting a roll of medium, the revolving arrangement comprising a friction ring, the friction ring rotating around a friction ring rotation axis; and a braking element comprising two pivotally arranged jaws, whereby the friction ring is bitten by said jaws; whereby the braking element is rotatable around the friction ring rotation axis.

15. A medium feeding system according to claim 14, whereby the rotation of the rotatable braking element is limited to a preset angle.

16. A medium feeding system according to claim 14, whereby the system further comprises a fixed abutment and a lever, the lever having a first end, a second end and a lever rotation axis, the lever rotation axis being parallel to the friction ring rotation axis, the rotation axis being fixed relative to a first one of said jaws, the first end of the lever abutting against the second one of said jaws when the second end of the lever abuts against a fixed abutment.

17. A medium feeding system according to claim 14, whereby the system further comprises a tensioning element, whereby the two pivotally arranged jaws are linked by the tensioning element.

18. A medium feeding system according to claim 17, whereby the tensioning element is a helicoidal spring.

19. A medium feeding system according to claim 14, whereby the system further comprises a fixed abutment and a lever, the lever having a first end, a second end and a lever rotation axis, the lever rotation axis being parallel to the friction ring rotation axis, the rotation axis being fixed relative to a first one of said jaws, the first end of the lever abutting against the second one of said jaws when the second end of the lever abuts against a fixed abutment, whereby the system further comprises a tensioning element, whereby the two pivotally arranged jaws are linked by the tensioning element.

20. A hardcopy apparatus comprising the medium feeding system according to claim 9.

21. A large format printer comprising the medium feeding system according to claim 14.

22. A medium feeding system for a hardcopy apparatus comprising:

a revolving arrangement for supporting a roll of medium, the revolving arrangement comprising a friction ring, the friction ring rotating around a friction ring rotation axis; and a braking element comprising two pivotally arranged jaws, whereby the friction ring is bitten by said jaws;

wherein the braking element is rotatable around the friction ring rotation axis; the medium feeding system further comprising:

means to push the jaws against the friction ring; and means to pull the jaws away from the friction ring;

wherein the means to pull the jaws away from the friction ring are triggered by the rotation of the friction ring.

* * * * *